US007375283B2

(12) United States Patent
Meeks

(10) Patent No.: US 7,375,283 B2
(45) Date of Patent: May 20, 2008

(54) MOLDED CONNECTOR FOR WATER OR FUEL SEALING

(75) Inventor: John Meeks, Mason, OH (US)

(73) Assignee: Standex International Corporation, Salem, NH (US)

( * ) Notice: Subject to any disclaimer, the term of this patent is extended or adjusted under 35 U.S.C. 154(b) by 0 days.

(21) Appl. No.: 11/541,791

(22) Filed: Oct. 2, 2006

(65) Prior Publication Data

US 2007/0082553 A1 Apr. 12, 2007

Related U.S. Application Data

(60) Provisional application No. 60/722,687, filed on Sep. 30, 2005.

(51) Int. Cl.
*H01R 4/00* (2006.01)

(52) U.S. Cl. ..... 174/84 R

(58) Field of Classification Search ..... 174/84 R, 174/85, 84 C, 76; 29/868, 883; 439/888
See application file for complete search history.

(56) References Cited

U.S. PATENT DOCUMENTS

| | | | | |
|---|---|---|---|---|
| 7,230,214 | B2 * | 6/2007 | Kirby | 219/535 |
| 2003/0015341 | A1 * | 1/2003 | Ito | 174/84 R |
| 2004/0074667 | A1 * | 4/2004 | Endacott | 174/84 R |

* cited by examiner

*Primary Examiner*—Phuong Dinh
(74) *Attorney, Agent, or Firm*—William B. Ritchie

(57) ABSTRACT

An electrical connector for use in an area subject to fluids such as gasoline or water. Typically, the connector would be used in a fuel injector to an electronic control module found in automotive and recreational motors. Once the wires have been stripped, they are then fused to a centering section to provide a common joint. The centering section is provided with a encapsulating mold centering section featuring two opposing alignment bosses and two sections of four circumferential centering tips. Finally, a second molding process is applied. The tips and the bosses re-melt or re-flow during the second encapsulation process to provide for a centered assembly that prevents fuel or water leaking from one wire to the next through the connection.

6 Claims, 3 Drawing Sheets

Fig. 1A PRIOR ART
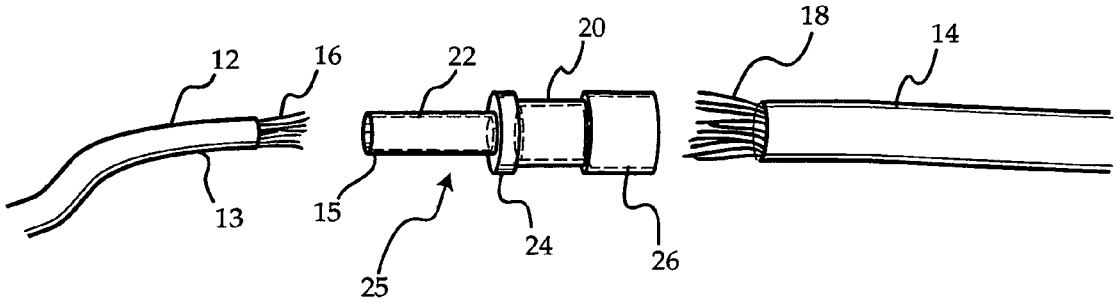
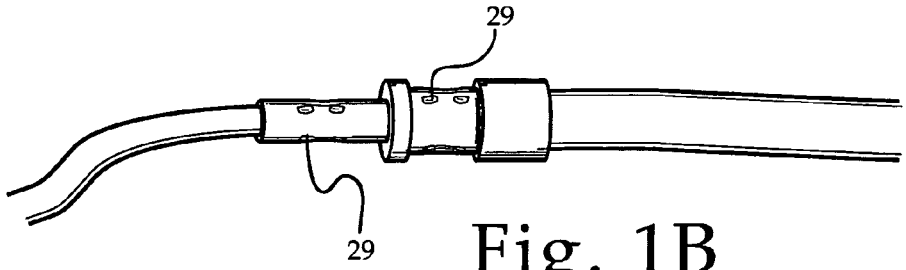
Fig. 1B
PRIOR ART
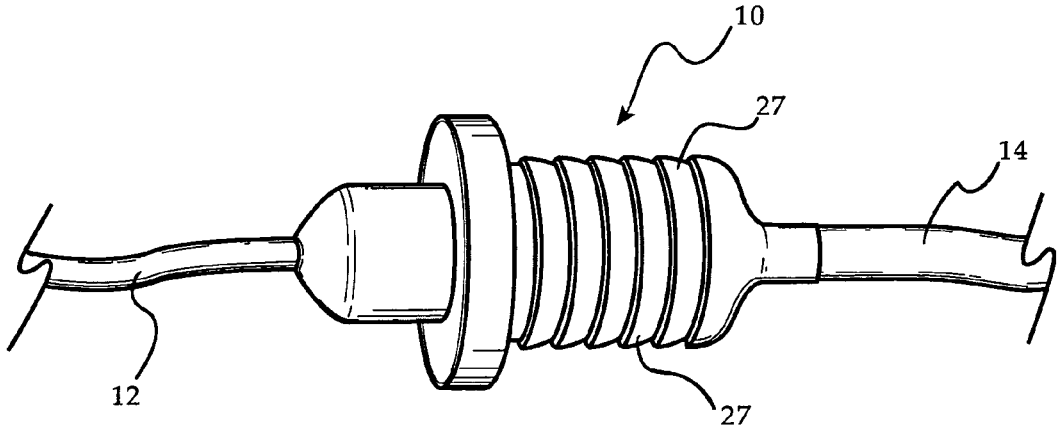
Fig. 2

MOLDED CONNECTOR FOR WATER OR FUEL SEALING

This application claims benefit under Title 35 USC, §119(e) of U.S. Provisional Application Ser. No. 60/722,687 filed Sep. 30, 2005.

FIELD OF THE INVENTION

This invention relates to electrical terminal connections, in particular, a splice terminal for connecting two different sized wires together for use in a liquid environment such as water or fuel.

BACKGROUND OF THE INVENTION

The present electrical terminal connections use a mechanical connection between the two wires and the terminal. This style of terminal is made by crimping stranded or solid wires to make an electrical connection wherein the electrical connection must be located in an area having fluid such as water or gasoline surrounding it. For example, a fuel injector to an electronic control module.

As shown in Prior Art FIG. 1A, when connecting two different sized stranded wires, 12, 16, each sized wire 12, 16 is placed in a hollow brass crimp ferrule 25 having two ends, with the inside diameter of each end corresponding to the diameter of the stranded wire to be held together. Section 22 corresponds to wire 12 and its wire strands 16 while section 26 corresponds to wire 14 and its wire strands 18. Section 26 extends into section 20. Section 22, 20 are only mechanically crimped 29 as shown in FIG. 1B to hold the two wires tightly together. Collar 24 which is integral with crimp ferrule 25 serves to provide a single fuel barrier as well as an anchor and a centering section (not shown). Solid wires or wires of the same diameter could also be used.

Since the connection between the outside of insulation 13 and the inside of 15 of the crimp ferrule depends solely on the tightness of fit, it is possible that the connection will fail due to the blind fit between the wire and connector, especially when subjected to repeated stress movement. The entire connection is molded with a covering (which will be discussed below) to maintain water tightness.

While this system works, the inventors have found that this process can be substantially improved upon by eliminating the costly crimp ferrule thus, eliminating the difficulty of making certain that the respective wires are properly inserted there for a proper crimping. To improve the water/gasoline tightness of the connector, multiple diameters serve as fuel barriers as well as maintaining the same amount of material for the pre-mold and the same dimensions for the overmold portion.

SUMMARY OF THE INVENTION

The invention is an electrical connector for use in an area subject to fluids such as gasoline or water. Typically, the connector would be used in a fuel injector to an electronic control module found in automotive and recreational motors. Once the wires have been stripped, they are then fused to a centering section to provide a common joint. The centering section is provided with a encapsulating mold centering section featuring two opposing alignment bosses and two sections of four circumferential centering tips. Finally, a second molding process is applied. The tips and the bosses re-melt or re-flow during the second encapsulation process to provide for a centered assembly that prevents fuel or water leaking from one wire to the next through the connection.

It is an aspect of the invention to provide a connector for two wires that can be used in a fluid environment without leaking.

It is another aspect of the invention to provide a connector that connects two different sized wires even when placed in a fluid environment such as gasoline, water or any application that requires electrical current flow in a fluid environment.

Another aspect of the invention is to provide a connector that has the same sized external plastic molded protective cover so that a defective part can be replaced with the new inventive part.

Still another aspect of the invention is to use no more molded material than had been used required for a Prior Art system.

Finally, it is an aspect of the invention to provide a connection that can be manufactured at a lower cost yet have a reliability that is equal or better than the present part it is being used to replace.

These and other aspects of the invention will become apparent in light of the detailed description of the invention which follows.

BRIEF DESCRIPTION OF THE DRAWINGS

FIG. 1A is a Prior Art drawing showing a detailed view of the hollow brass crimp ferrule that has been replaced by the present invention.

FIG. 1B is a prior art drawing showing a detailed view of the hollow brass crimp ferrule that has been crimped on two wires.

FIG. 2 is an isometric view of the completed connector in accordance with the invention.

DESCRIPTION OF THE PREFERRED EMBODIMENTS

Figure 3:
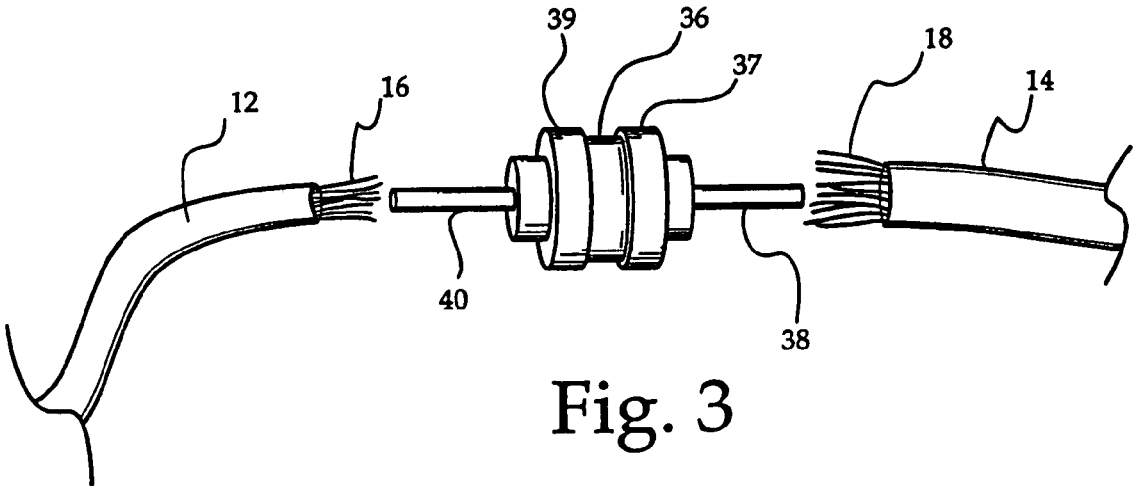
FIG. 3 is a detailed view of the copper crimp pin that replaces the crimp ferrule.

FIG. 2 is an isometric view of the completed connector 10. As can be seen, insulated wire 14 has a substantially greater diameter than insulated wire 12. Overmold section 11 of connector 10 has substantially the same dimensions of the overmold section (not shown) of the prior art except the non-locking diameter 15 is slightly larger. Locking threads 27 enable connector 10 to be rigidly attached through a properly sized opening. Thus, connector 10 can easily replace the prior art connector.

Figure 4:
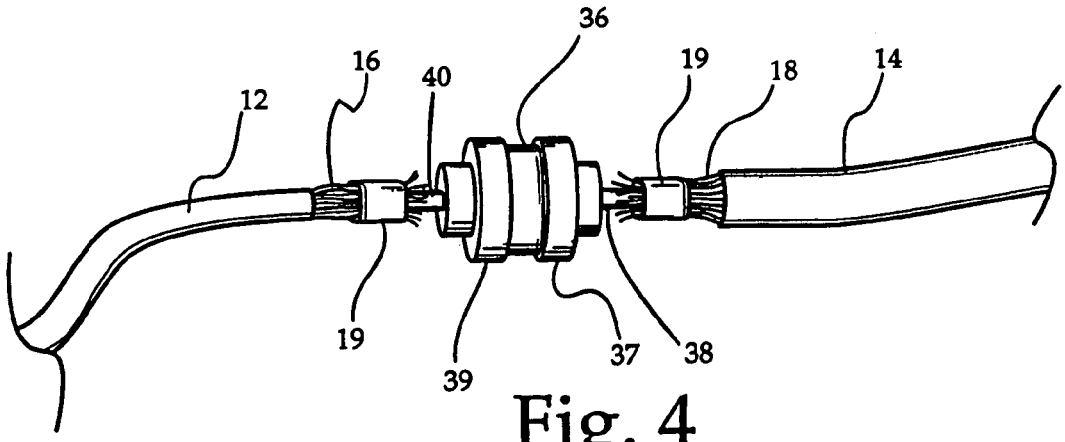
FIG. 4 is a detailed view of the crimp attached to stranded wires.

To fabricate connector 10, wires 12, 14 first have a short portion of the insulation stripped from the end as shown in FIG. 3. Preferably, multi-stranded wire 16, 18, respectively, is used but solid wire could also be substituted if desired. Copper could be used for crimp pin 36 but brass is preferable. Crimp pin 36 has opposing pins 40, 38 which are used to mount wires 12, 14 to the terminal via fusing 19 to multi-stranded wires 16, 18 and to pins 40, 38 respectively, as shown in FIG. 4. The multiple diameters 36, 37, 39 provide for fuel barriers to keep fuel or water going from one side to the other via osmotic pressure of the fluid.

Figure 5:
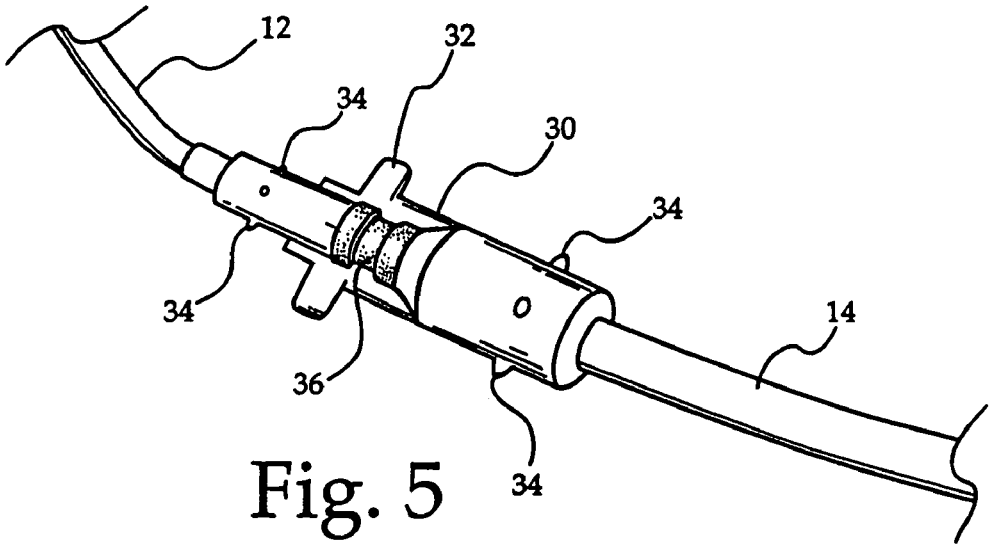
FIG. 5 is a detailed view of the molded centering section.
Figure 6:
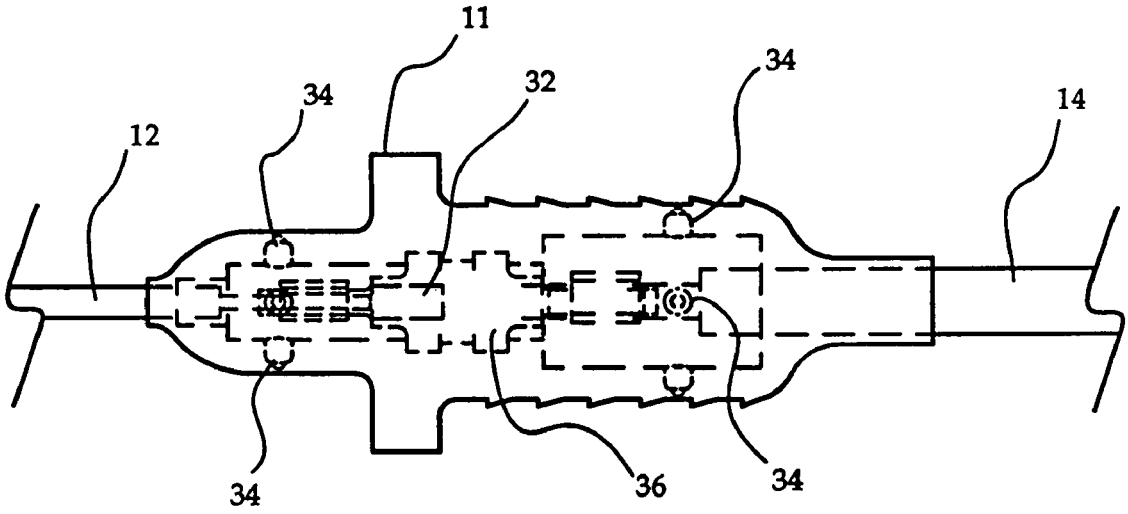
FIG. 6 is a side view of the overmold section once it has been molded over the molded centering section.

Referring to FIG. 5, the fused wires 12, 14 and crimp pin 36 are inserted in an encapsulating mold centering section 30. As show in FIG. 5, encapsulating mold centering section 30 provides two rows of circumferential centering tips 34, one fore and one aft, as well as two opposing alignment bosses 32. The product is completed by encapsulating this structure to provide for a perfectly centered structure as shown in FIG. 6. The tips 34 and bosses 32 have tapered ends that re-melt which provides a seamless final encapsulation 10 having a water tight seal.

While certain representative embodiments of the invention have been described herein for the purposes of illustration, it will be apparent to those skilled in the art that modification therein may be made without departure from the spirit and scope of the invention.

What is claimed is:

1. A process for making an electrical connector for joining two wires each having an insulated end such that said electrical connector is used in a fluid environment wherein said process comprises the steps:

stripping the insulation off the ends of each of said two wires;

fusing said wires to a common center such that said two wires oppose one another;

placing said common center with the fused wires into an encapsulating mold center section wherein said encapsulating mold center section has two rows of circumferential tips as well as at least two alignment bosses;

encapsulating the above structure with a molded cover wherein said tips and bosses of said mold centering section re-melt to provide a seamless fluid seal around the fused ends of said wires.

2. The process of claim 1 wherein said wires have substantially different diameters.

3. The process of claim 1 wherein said wires are multi-stranded.

4. The process of claim 2 wherein said common center has opposing pins, which said wires, are fused.

5. The process of claim 3 wherein said common center has three circumferential barriers wherein the center barrier has a substantially smaller diameter than each barrier on either side of it such that the osmotic pressure of the fluid is prevented from moving from one wire to the other.

6. The process of claim 5 wherein said encapsulated cover has substantially the same diameter of prior art devices such that said electrical connection can easily replace the prior art devices with locking threads molded into said cover to hold said electrical connector in place.

* * * * *